US010190353B2

(12) United States Patent
Collins et al.

(10) Patent No.: US 10,190,353 B2
(45) Date of Patent: Jan. 29, 2019

(54) AUTOMATIC DOOR INSTALLATION

(71) Applicant: Ensota (Guangzhou) Technologies Ltd., Guangzhou (CN)

(72) Inventors: Peter Collins, Cheltenham (GB); John Curzon, Cheltenham (GB)

(73) Assignee: Ensota (Guangzhou) Technologies Ltd., Guangzhou (CN)

( * ) Notice: Subject to any disclaimer, the term of this patent is extended or adjusted under 35 U.S.C. 154(b) by 0 days.

(21) Appl. No.: 15/490,295

(22) Filed: Apr. 18, 2017

(65) Prior Publication Data

US 2017/0314314 A1 Nov. 2, 2017

(51) Int. Cl.
*E05F 15/43* (2015.01)
*E05F 15/73* (2015.01)

(52) U.S. Cl.
CPC ..... *E05F 15/43* (2015.01); *E05F 15/73* (2015.01); *E05F 2015/434* (2015.01);
(Continued)

(58) Field of Classification Search
None
See application file for complete search history.

(56) References Cited

U.S. PATENT DOCUMENTS 4,029,176 A * 6/1977 Mills ..... B66B 13/26 187/317
5,925,858 A * 7/1999 Full ..... B66B 13/26 187/317

(Continued)

FOREIGN PATENT DOCUMENTS

EP 0699619 A2 3/1996
WO 9858867 A 12/1998

OTHER PUBLICATIONS

Search Report issued by British Intellectual Property Office in Related related GB Patent Application No. GB1607381.9 dated Oct. 17, 2016.

*Primary Examiner* — K. Wong
(74) *Attorney, Agent, or Firm* — Gesmer Updegrove LLP

(57) ABSTRACT

There is disclosed an automatic door installation 100 configured to determine the presence of an obstacle 150 in one or more detection zones remote from a door opening, comprising: at least a first door 104 slidable in a door opening along a horizontal door axis from an open configuration to a closed configuration during a door closing operation; a plurality of transmitter-receiver pairs, each transmitter-receiver pair comprising: a transmitter 116 for transmitting a beam 140 and a receiver 118 for receiving a reflection of the beam, wherein one of the transmitter 116 and the receiver 118 is coupled to the first door so that, in use, the transmitter and receiver move closer together during the door closing operation; wherein the transmitter 116 defines a transmitter axis 120 corresponding to the optical axis of the beam; wherein the receiver 118 has a field of view 142 for receiving the beam, which is oriented around a receiver axis; and wherein the transmitter axis 120 and the receiver axis 122 are configured so that the beam and the field of view overlap to define a detection zone for the transmitter-receiver pair in at least one operational configuration of the door installation. At least one of the transmitter axis 120 and the receiver axis 122 is inclined with respect to the horizontal plane and the transmitter 116 is vertically spaced apart from the receiver 118.

20 Claims, 7 Drawing Sheets

(52) U.S. Cl.
CPC ... *E05F 2015/435* (2015.01); *E05F 2015/436* (2015.01); *E05F 2015/765* (2015.01); *E05Y 2900/106* (2013.01)

(56) References Cited

U.S. PATENT DOCUMENTS

| | | | | |
|---|---|---|---|---|
| 6,304,178 | B1 * | 10/2001 | Hayashida | G01V 8/10 340/545.1 |
| 6,631,788 | B2 * | 10/2003 | Shikai | B66B 13/26 187/316 |
| 7,044,271 | B2 * | 5/2006 | De Coi | B66B 13/26 187/316 |
| 8,904,708 | B2 * | 12/2014 | Zacchio | B66B 13/26 49/25 |
| 9,145,727 | B2 * | 9/2015 | Albers | E05F 15/73 |
| 2004/0014782 | A1 | 1/2004 | Krause | |

* cited by examiner

AUTOMATIC DOOR INSTALLATION

PRIORITY INFORMATION

This application claims priority to EP Application No. 1607381.9, filed on Apr. 28, 2016 which is incorporated herein by reference in its entirety.

The invention relates to an automatic door installation for determining the presence of an obstacle in one or more detection zones remote from a door opening of the installation.

Automatic door installations, such as entrance doors and elevator installations, typically comprise a number of optical door sensors for determining the presence of an obstacle, for example, to prevent, halt or reverse a door closing operation when an obstacle is detected.

In a typical automatic door installation, such as an elevator installation, there may be a fixed door sensor configured to project a light curtain in front of two opposing sliding doors. In particular, there may be a plurality of transmitters opposing a corresponding plurality of receivers, and the transmitters may transmit beams of light to the receivers. When a beam is not received, a controller may determine that an obstacle is present. This type of sensor is sometimes referred to as a break-beam sensor, and can be fixed on the installation (e.g. mounted on the elevator car), or may be partially or fully mounted on the moving doors.

A further type of optical sensor is configured to determine the presence of an obstacle in a remote region from the doors (i.e. remote from the plane of the door gap, and/or light curtain). This type of sensor relies identifies an obstacle in the proximity region when a beam transmitted towards to the proximity region is reflected back (from an obstacle) to a receiver. Accordingly, this type of "proximity sensor" determines the presence of an obstacle when a reflected beam is received.

Figure 1:
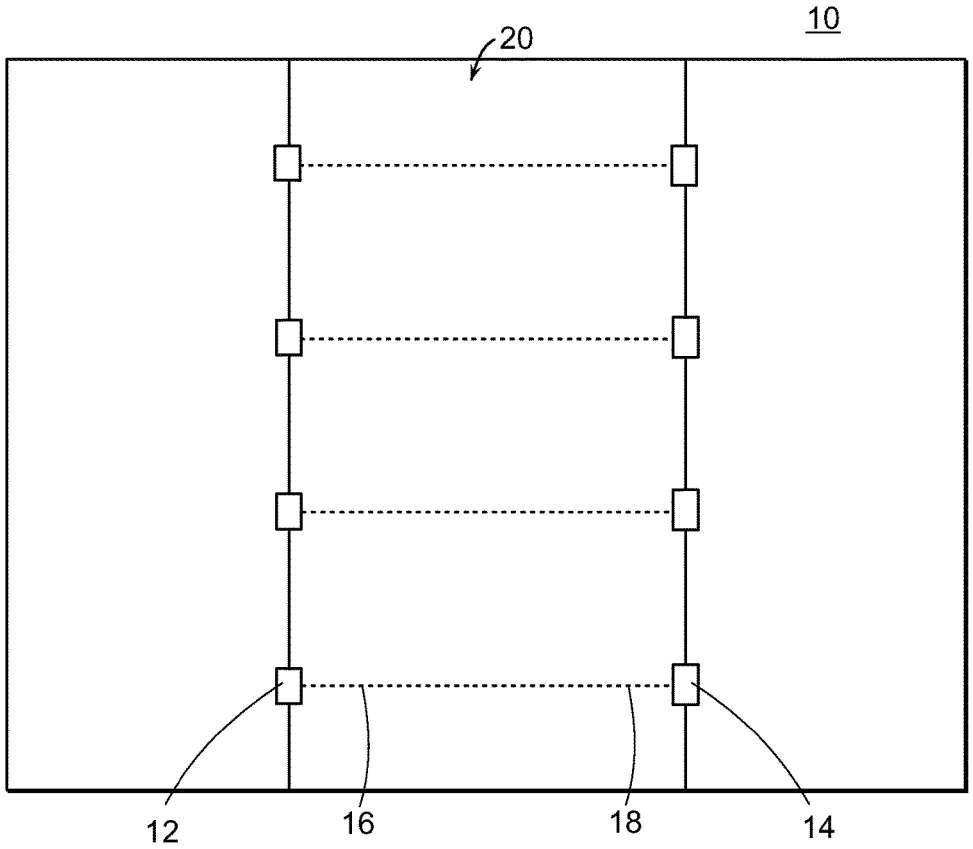
Figure 2:
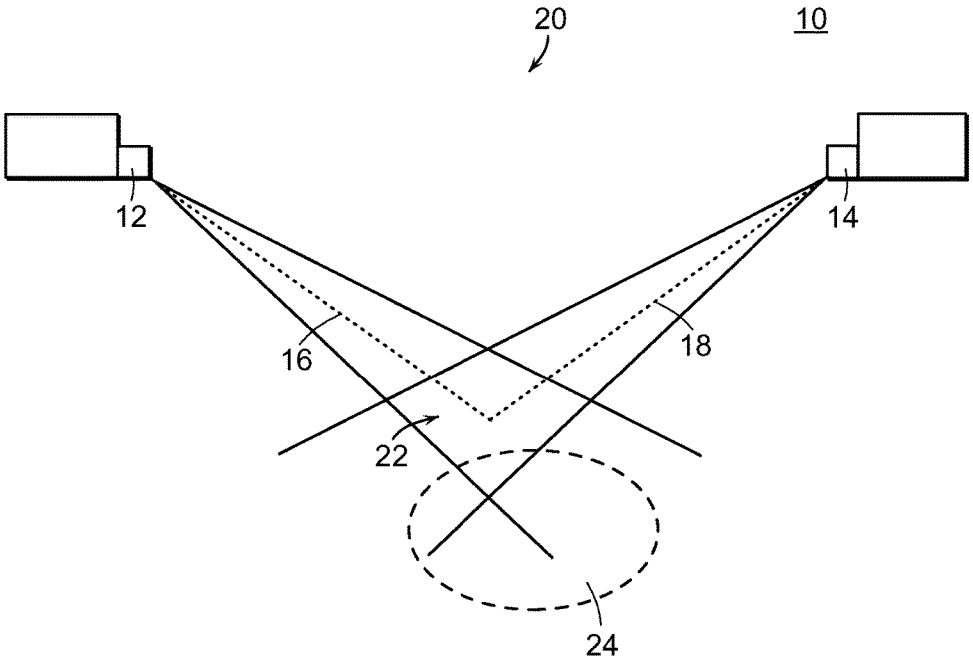

An example automatic door installation 10 comprising a proximity sensor is shown in FIGS. 1 and 2. The proximity sensor comprises a transmitter array comprising a plurality of transmitters 12, and a receiver array comprising a plurality of receivers 14. The transmitters 12 are located directly opposite the receivers. Each transmitter 12 is configured to transmit an optical beam dispersed around a respective transmitter axis 16 of the transmitter. Each receiver 14 has a field of view centred around a receiver axis 18. As shown in FIG. 2, the transmitter axis 16 and receiver axis 18 extend obliquely with respect to a door gap 20 to define a detection zone 22 in front of the door gap where the path of the optical beam and the field of view overlap.

The intensity of light received along a reflected pathway is significantly lower than the intensity of the optical beam as transmitted, and the intensity of light receives decreases with increasing length of the reflected pathway. Accordingly, such proximity sensors are typically configured to determine that an obstacle 24 is present based on relatively low levels of light intensity received.

However, such sensors are also susceptible to falsely determining the presence of an obstacle, for instance, owing to cross-talk between the transmitters and receivers (e.g. co-channel interference).

It is desirable to minimise occurrences when an obstacle is falsely determined to be present. In particular, this may occur when light is received by a receiver along a direct or indirect pathway which does not include reflection from an obstacle in the detection zone.

Accordingly, it is desirable to provide an improved automatic door installation.

According to an aspect of the invention there is provided an automatic door installation configured to determine the presence of an obstacle in one or more detection zones remote from a door opening, comprising: at least a first door slidable in a door opening along a horizontal door axis from an open configuration to a closed configuration during a door closing operation; a plurality of transmitter-receiver pairs, each transmitter-receiver pair comprising: a transmitter for transmitting a beam and a receiver for receiving the beam along a reflected pathway, wherein one of the transmitter and the receiver is coupled to the first door so that, in use, the transmitter and receiver move closer together during the door closing operation; wherein the transmitter defines a transmitter axis corresponding to the optical axis of the beam; wherein the receiver has a field of view for receiving the reflection of the beam, which is oriented around a receiver axis; wherein the transmitter axis and the receiver axis are configured so that the beam and the field of view overlap to define a detection zone for the transmitter-receiver pair in at least one operational configuration of the door installation; wherein at least one of the transmitter axis and the receiver axis is inclined with respect to the horizontal plane; and wherein the transmitter is vertically spaced apart from the receiver.

The automatic door installation may comprise an optical door sensor comprising the plurality of transmitter-receiver pairs.

The door opening may be substantially orthogonal with respect to the horizontal plane. The detection zones may be in front of the door opening.

The transmitter axis and the receiver axis may be non-parallel with respect to each other. Projections of the transmitter axis and the receiver axis on the plane of the door opening may be non-parallel with respect to each other.

There may be at least two, at least three, at least four, at least five, at least ten or more transmitter-receiver pairs.

The transmitters and receivers may be staggered so that each transmitter is vertically spaced apart from each receiver. Each and every transmitter of the automatic door installation having a transmitter axis inclined with respect to the plane of the door opening (i.e. for detecting an obstacle in front of the door) may be vertically spaced apart each and every receiver of the automatic door installation having a receiver axis inclined with respect to the plane of the door opening. The automatic door installation may have no transmitters which both have a transmitter axis inclined with respect to the plane of the door opening and which are vertically aligned with a receiver having a receiver axis inclined with respect to the plane of the door opening.

Each transmitter-receiver pair may define a respective detection zone, and the centres of the detection zones may be vertically spaced apart.

The transmitter-receiver pairs may be configured so that the centres of the detection zones are vertically spaced apart when the automatic door installation is in the open configuration.

The beam may be dispersed around the transmitter axis. In particular, the intensity of the beam may be greatest along the transmitter axis and may reduce away from the transmitter axis, for instance, in dependence on the angular separation from the transmitter axis. The sensitivity of the receiver to a reflected beam may vary in dependence on the orientation of the reflected beam relative the receiver axis. In particular, the sensitivity of the receiver may be at a maximum for reflected beams received along the receiver axis, and the sensitivity may reduce for signals received away from the receiver axis, for instance, in dependence on the angular separation from the receiver axis.

The transmitter and the receiver may be configured so that, in use, the receiver receives the reflected beam from the transmitter along a reflecting pathway including reflection from an obstacle in the respective detection zone. The transmitter and the receiver may be configured so that, in use, there is no non-reflecting (i.e. direct) pathway between the transmitter and the receiver along which the beam can be received without reflection. For example, any non-reflecting pathways may be blocked, for example, by housings or optical guides of the transmitter and/or receiver.

Alternatively, the transmitter and the receiver may be configured so that the intensity of a beam and/or the sensitivity of the receiver along a non-reflecting (i.e. direct) pathway between the transmitter and the receiver is below a threshold for determining that an obstacle is present in the respective detection zone. The automatic door installation may comprise a controller configured to determine whether the intensity of a beam (reflected or non-reflected) received by the receiver is above a threshold corresponding to the presence of an obstacle in the respective detection zone.

The automatic door installation may include a controller configured to determine whether a beam from a transmitter is received by each receiver, and to thereby determine whether an obstacle is present in the respective detection zone.

The location and/or size of the detection zones may vary during the door closing operation.

For each transmitter-receiver pair, at least one of the transmitter axis and the receiver axis may be substantially horizontal. In other words, at least one of the transmitter axis and the receiver axis may lie in the horizontal plane.

Each detection zone may be remote from the plane of the door opening. Each detection zone may be remote from the threshold of the door opening.

The transmitter axes of the plurality of transmitter-receiver pairs may be substantially parallel with each other. The receiver axes of the plurality of transmitter-receiver pairs may be substantially parallel with each other.

Each transmitter-receiver pair may be configured so that there is a reflecting pathway between the transmitter and receiver when a reflecting obstacle is disposed in the respective detection zone.

Each transmitter-receiver pair may be configured so that the intensity of the beam along the reflecting pathway from the transmitter to the detection zone is greater than the signal intensity of the beam along a non-reflecting pathway extending directly between the transmitter and receiver. This may apply throughout a door closing operation. Alternatively, this may apply throughout a door closing operation until the horizontal separation between the transmitter and receiver reaches a lower threshold, such as 100 mm.

Each transmitter-receiver pair may be configured so that a shortest distance of separation between the transmitter axis and the receiver axis varies during the door closing operation. The shortest distance may extend between respective points on the transmitter axis and the receiver axis. The respective points on the transmitter axis and the receiver axis or a point on the line between them may lie in the respective detection zone. A midpoint on the line of shortest separation between the transmitter axis and the receiver axis may define a centre of the detection zone. The shortest distance of separation between the transmitter and receiver axis may increase during the door closing operation.

For each transmitter-receiver pair, the intensity of a reflected beam from the transmitter along a reflecting pathway may depend on the separation between the transmitter axis and the respective receiver axis (i.e. the shortest distance of separation between them), and may therefore reduce during the door closing operation.

The transmitter and the receiver of each transmitter-receiver pair may be configured so that a reflecting angle between a vector extending from the transmitter to the centre of the detection zone and a vector extending from the centre of the detection zone to the receiver decreases during a door closing operation. The centre of the detection zone may be the mid-point on the line of shortest separation between the transmitter axis and the receiver axis.

In general, the intensity of a reflected beam may decrease with decreasing reflecting angle assuming the length of the reflecting pathway remains constant. Conversely, in general the intensity of a reflected beam may increase with decreasing length of the reflecting pathway assuming the reflecting angle remains constant. Accordingly, having a decreasing reflecting angle with decreasing reflecting pathway length may balance these two trends to optimise the intensity of a reflected beam during the door closing operation (i.e. so that it is relatively constant).

The angle between respective projections of the transmitter axis and the receiver axis onto the plane of the door opening may be between 150° and 170°. The respective projections may be orthogonal projections, i.e. orthogonal with respect to the plane of the door opening.

For each transmitter-receiver pair, one of the transmitter axis and the receiver axis may be inclined with respect to the horizontal plane by an angle of between 50° and 60°, for example between 10° and 20°. The respective transmitter or receiver axis may be inclined downwardly towards the respective detection zone. Orienting the receivers downwardly may help to limit ambient light (which tends to be directed downwardly) falling on the sensors, which may contribute to background noise affecting the receiver output signal.

The automatic door installation may further comprise a second door slidable in the door opening opposite the first door, and the transmitter and the receiver of each transmitter-receiver pair may be respectively mounted on opposing doors.

Each transmitter-receiver pair, or a controller of the automatic door installation, may be configured so that the presence of an obstacle is only determined when a receiver receives an optical signal from a respective transmitter of the same pair.

For example, each pair or the controller may be configured to only determine whether an optical signal has been received in pre-determined time periods, so that it may be determined whether the optical signal was received from a transmitter of the same pair or not. Further, each transmitter may be configured to transmit a beam carrying a different signal so that it may be determined from which transmitter a reflected beam is received. For example, the optical signals may contain embedded codes or may be of different formats.

Each transmitter-receiver pair may have any combination of the features defined above.

The vertical separation between a transmitter of a first transmitter-receiver pair and a receiver of a second transmitter-receiver pair may be less than the vertical separation between the transmitter and the respective receiver of the first pair.

The transmitters may be arranged in a transmitter array and the receivers may be arranged in a receiver array. One of the arrays may be mounted on the first door. Where the installation comprises a second door, the other of the arrays may be mounted on the second door.

The automatic door installation may be an elevator installation.

Figure 3:
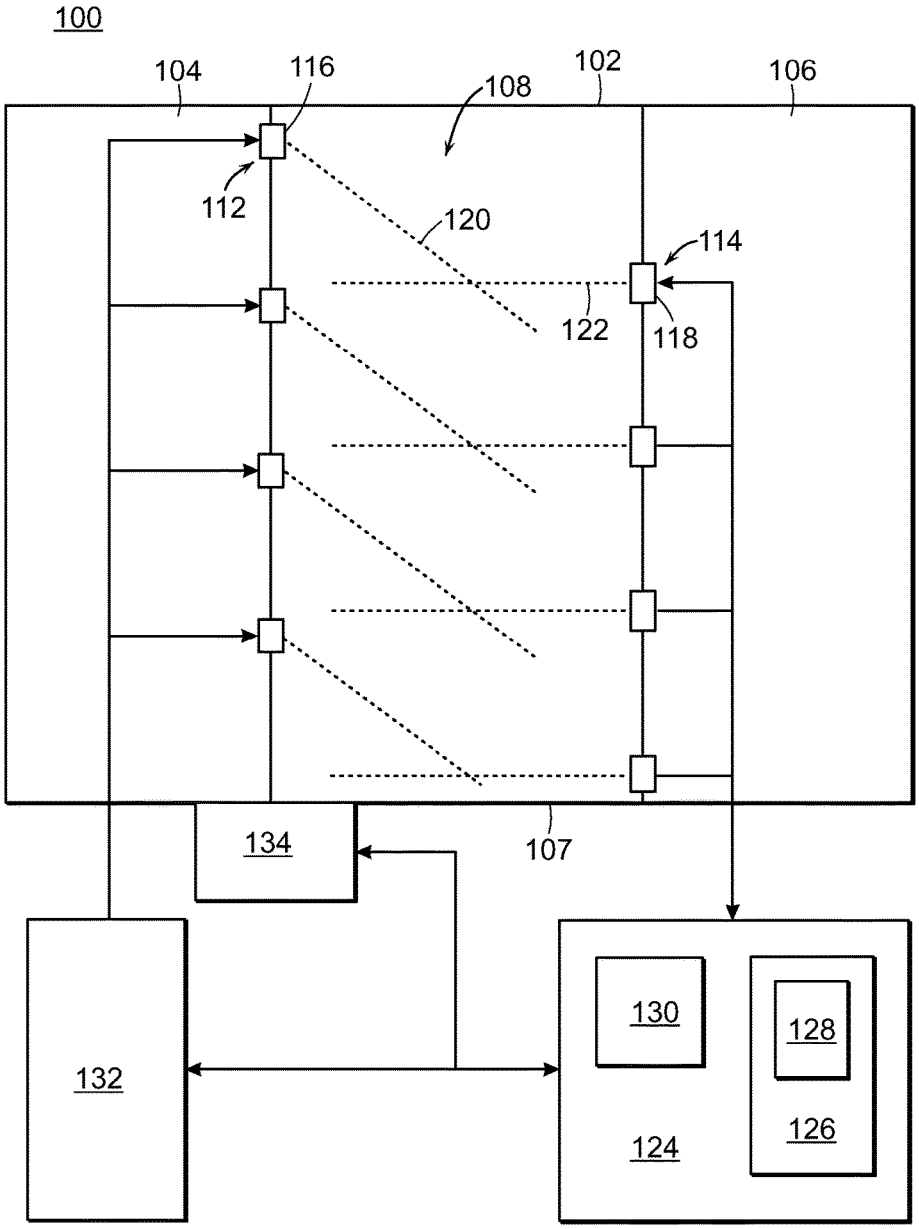
Figure 4:
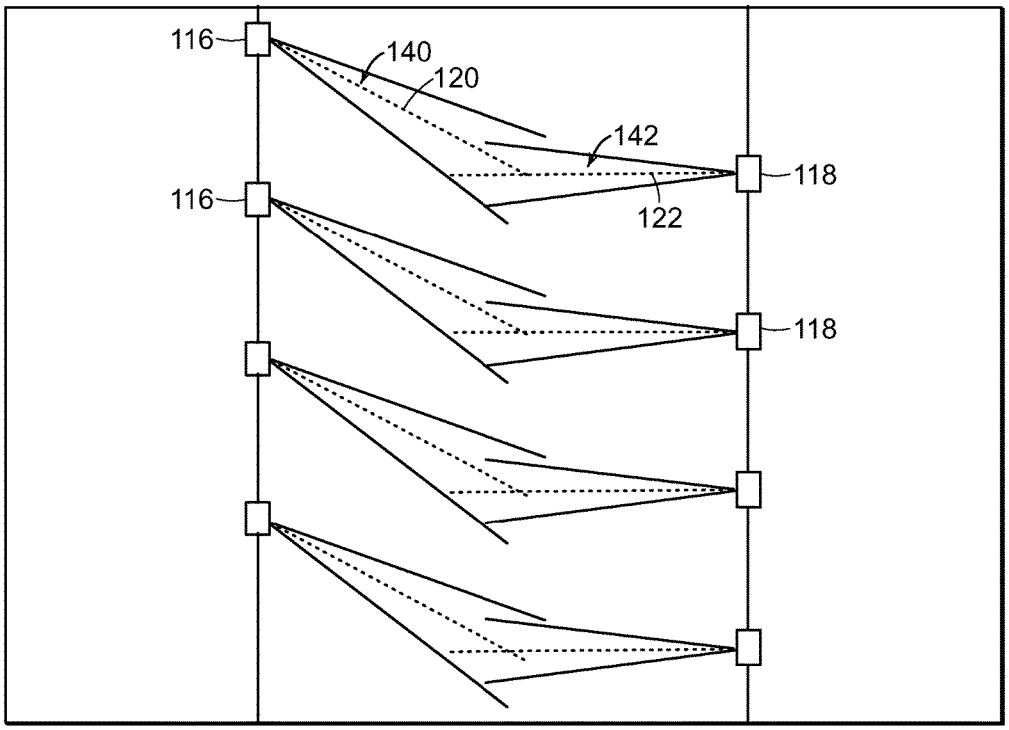
Figure 5:
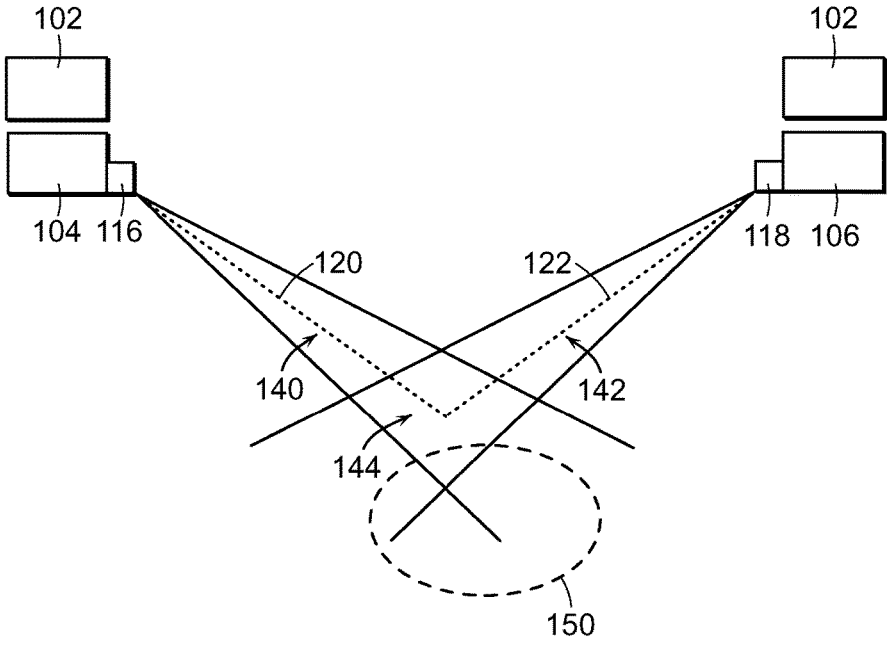
Figure 6:
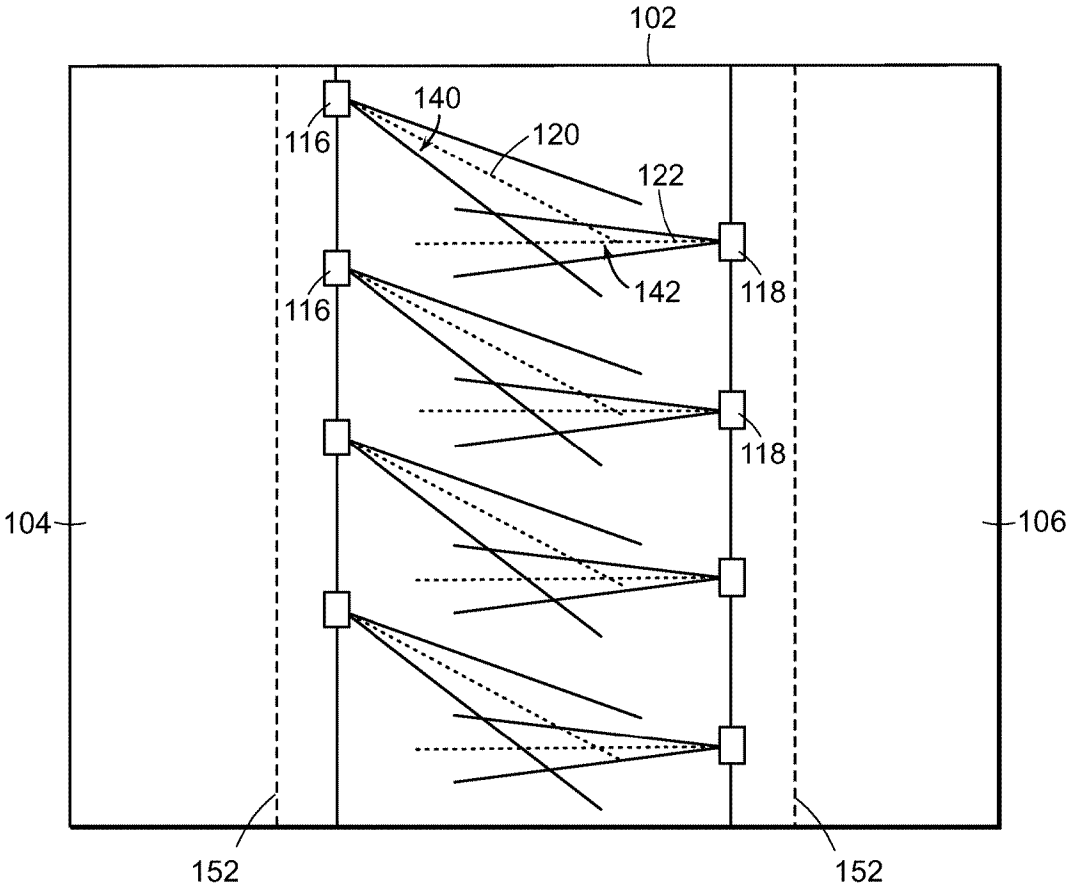
Figure 7:
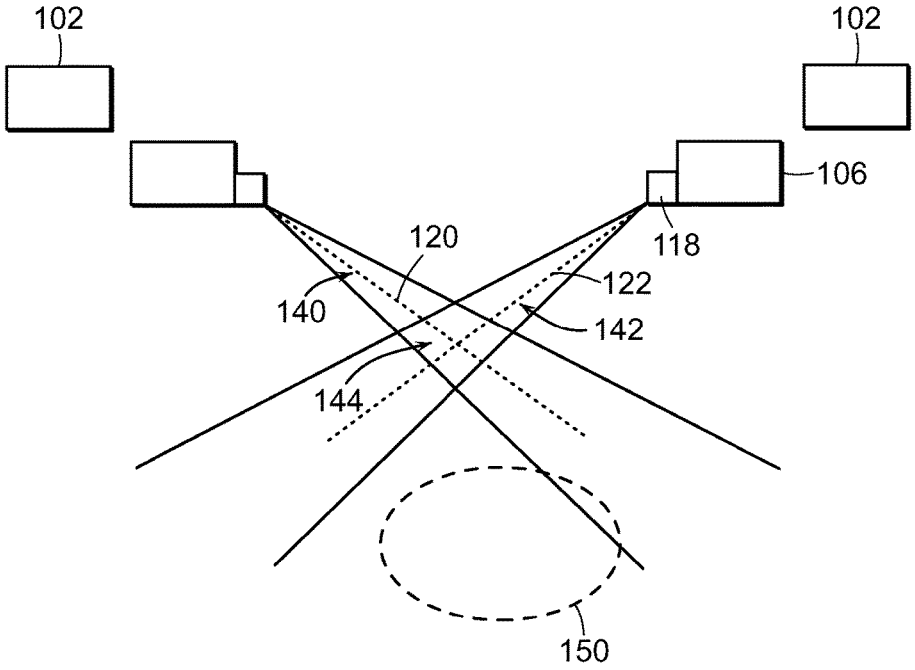

The invention will now be described, by way of example, with reference to the accompanying drawings, in which:

FIG. 1 schematically shows a typical automatic door installation comprising a proximity sensor;

FIG. 2 schematically shows an obstacle detection example for the automatic door installation of FIG. 1;

FIG. 3 schematically shows an automatic door installation according to an embodiment of the invention;

FIG. 4 schematically shows a plan view of a first obstacle detection example for the automatic door installation of FIG. 3;

FIG. 5 schematically shows a front view of a first obstacle detection example for the automatic door installation of FIG. 3;

FIG. 6 schematically shows a plan view of a second obstacle detection example for the automatic door installation of FIG. 3; and FIG. 7 schematically shows a front view of a second obstacle detection example for the automatic door installation of FIG. 3.

FIG. 3 shows an automatic door installation 100 for an elevator, comprising an elevator car 102 having left and right car doors 104, 106 slidable relative one another above a door threshold 107 to open and close a door gap 108 defined therebetween. In this embodiment, both doors are configured to slide between a fully open operational configuration defining a maximum door gap of 2 m, and a closed operational configuration in which the edges of the doors 104, 106 meet.

The automatic door installation 100 comprises a proximity sensor having a transmitter array 112 mounted on the inward-facing edge of the left car door 104, and a receiver array 114 mounted on the inward-facing edge of the right car door 106. The arrays 112, 114 are mounted on the front faces of the respective doors adjacent the respective door edges.

The transmitter array 112 comprises a plurality of evenly spaced-apart infrared transmitters 116. In particular, there are 4 transmitters vertically spaced apart by intervals of 400 mm from a lowest transmitter (transmitter ID 1) at a height of 500 mm above the door threshold 107 to a highest transmitter (transmitter ID 4) at a height of 1700 mm above the door threshold.

The receiver array 114 comprises a plurality of evenly spaced-apart infrared receivers 118. In particular, there are 4 receivers vertically spaced apart by intervals of 400 mm from a lowest receiver (receiver ID 1) at a height of 200 mm above the door threshold 107 to a highest receiver (receiver ID 4) at a height of 1400 mm above the door threshold.

As shown, in this embodiment the individual transmitters 116 and receivers 118 are staggered with respect to each other, such that the first transmitter 116 (i.e. the lowest, transmitter ID 1) is 300 mm above the first receiver 118 (i.e. the lowest, receiver ID 1). Accordingly, in this embodiment, none of the transmitters 116 and receivers 118 are at the same vertical position (height). Further, in this particular embodiment, the transmitter 116 of each transmitter-receiver pair is vertically closer to the receiver 118 of the adjacent transmitter-receiver pair (receiver ID 2) than to the corresponding receiver. For example, in this embodiment, transmitter ID 1 is at a vertical position of 500 mm above the threshold 107, whereas receiver IDs 1 and 2 are at respective vertical positions of 200 mm and 600 mm. Transmitter ID 1 is therefore vertically closer to receiver ID 2 than receiver ID 1. In other embodiments, one or more transmitters may be level (i.e. at the same vertical position) with opposing receivers.

As shown in FIGS. 3-5, each transmitter 116 is configured to transmit an infrared optical beam 140 along a beam path dispersed around a transmitter axis (or beam axis) 120 of the transmitter 116. In this embodiment the beam path 140 is limited by a transmitter housing, for example a frustoconical wall disposed around the transmitter having an open distal end for transmission of the beam. Each transmitter is configured so that the light intensity of the beam is greatest along the transmitter axis 120, and reduces in intensity at increasing angles away from the transmitter axis 120. In this embodiment, the transmitters 116 are arranged so that the respective transmitter axes 120 are parallel with one another and are inclined below the horizontal by approximately 17°. Further, each transmitter axis 120 extends obliquely with respect to the plane of the door gap 108 by 45° so that the optical beam extends in front of the door gap 108 and towards the receiver array 114 (as best shown in FIG. 5).

Each receiver 118 is configured to receive infrared optical beams along a field of view 142 arranged around a receiver axis 122 of the receiver 118. In this embodiment the field of view 142 is limited by a receiver housing, for example a frustoconical wall disposed around the receiver having an open distal end for reception of a reflected beam 140. Each receiver is configured so that the receiver is most sensitive to light received along the receiver axis 122, and is of reducing sensitivity for light received along paths at increasing angles away from the receiver axis 122. In this embodiment, the receivers 118 are arranged so that the respective receiver axes 122 are parallel with one another and are substantially horizontal. Further, each receiver axis 122 extends obliquely with respect to the plane of the door gap 108 by 45° so that the field of view is oriented in front of the door gap 108 and towards the transmitter array 112 (as best shown in FIG. 5).

As shown in FIG. 3, the transmitters 116 are coupled to a transmitter controller 132 which is configured to control the transmitters 116 to transmit the respective optical beams. In this particular embodiment, the transmitter controller 132 is configured to operate the transmitters 116 on a repeating detection cycle, so that the four transmitters 116 transmit their respective optical beams in sequence, for example, between 20 and 100 times per second (between 10 and 50 millisecond (ms) cycle times).

The optical sensor 110 also comprises a processor unit 124 coupled to the transmitter controller 132 and configured to determine whether an obstacle is present in any of the detection zones 144 based on the output of the receivers 118.

The receivers 118 are coupled to the processor unit 124 so that in use the processor unit 124 receives a respective receiver output signal individually from each receiver 118 corresponding to the intensity of infrared light received at the respective receiver 118. Accordingly, the receivers 118 are coupled to the processor unit 124 in a multiplexed configuration (i.e. configured to communicate the receiver output signals on separate channels).

The processor unit 124 comprises a processor 130 and is configured to process only those portions of each respective receiver output signal which correspond to transmission of the optical beam from the corresponding transmitter, based on the sequential operation of the transmitters (as determined based on a link between the transmitter controller 132 and the processor unit), such that there are four transmitter-receiver pairs each comprising a transmitter 116 and a corresponding receiver 118. Accordingly, each transmitter-receiver pair is time-division multiplexed such that an obstacle can only be determined to be present when an optical beam from the transmitter of the pair is received by the corresponding receiver (rather than received by any one of the receivers). In other embodiments, the processor unit 124 may be configured to determine the presence of an obstacle based on the reception of a reflected optical beam by any one of the receivers. For example, the transmissions from the transmitters 116 may not be time-division multiplexed, and/or the processor unit 124 may not restrict the analysis of each respective receiver output signal to those portions which correspond to the opposing transmitter only.

A method of determining the presence of an obstacle will now be described, by way of example, with reference to a first obstacle detection example shown in FIGS. 4 and 5.

FIG. 4 shows a plan view of the automatic door installation 100 in a first obstacle detection example when the doors 104, 106 are spaced apart in a fully open configuration to define a door gap of 2 m (the maximum door gap in this example embodiment). In this configuration, the doors 104, 106 are arranged so that the transmitter beam path 140 and the receiver field of view 142 of each transmitter-receiver pair overlap in a respective detection zone 144 (FIG. 5) in front of the doors so that a respective beam transmitted by the transmitter 116 may be reflected within the detection zone when an obstacle is present therein. In this particular example, in the fully open configuration (2 m door gap), the transmitter axis 120 for each transmitter 116 intersects the receiver axis 122 for the corresponding receiver 118. For example, the transmitter axis 120 for transmitter ID 1 (the lowest transmitter) intersects with the receiver axis 122 for receiver ID 2 (the lowest receiver) at a location approximately 1 m forward from the plane of the door gap, 200 mm above the door threshold (i.e. at the same height as the horizontal receiver axis 122), and laterally equidistant between the two doors. Accordingly, in this embodiment, the transmitter axes are inclined approximately 17° (16.7°) below the horizontal in the plane of the door gap (i.e. the orthographic projection of the transmitter axis onto the door gap). Since the transmitter axes are oblique with respect to the plane of the door gap by an angle of 45°, the true transmitter axes extend approximately 12° below the horizontal. The three other transmitter-receiver pairs have intersecting transmitter and receiver axes 120, 122 at the same lateral (horizontal between the doors) and longitudinal (horizontal perpendicular to the door gap) locations, but at vertical locations of 600 mm, 1000 mm and 1400 mm above the threshold 107 respectively, as shown in FIG. 4.

It will be appreciated that it is not necessary for the axes to intersect, but intersection is referred to herein as an example that the separation between the axes is at a minimum when the doors 104, 106 are in the fully open configuration.

As shown in FIG. 5, the beam path 140 from the transmitter 116 of one of the transmitter-receiver pairs is dispersed around the transmitter axis 120, and the field of view 144 for the receiver 118 is dispersed around the transmitter axis 122 to define a detection zone 144 dispersed around the intersection between the axes 120, 122. For example, the detection zone 144 may have a radius from its centre of approximately 0.5 m when the door is in a fully open configuration.

In use, the processor unit 124 and transmitter controller 132 cause the transmitters 116 to transmit their respective optical beams according to a predetermined timing sequence. For example, the carrier frequency may be between 30 khz and 200 khz, and a transmission may comprise 15 corresponding cycles of light output, such that the time period for each transmission is between 0.5 ms and 75 ms, and the time to complete a detection cycle of four transmissions (one from each transmitter 116) is between 2 ms and 300 ms. The processor unit 124 continuously receives the receiver output signals from the four receivers 118 on separate channels, which signals relate to the intensity of infrared light received at the respective receiver 118. For each detection cycle of transmissions, the processor unit 124 correlates a respective portion of each receiver output signal with the timing of the respective transmission based on the timing sequence for the detection cycle.

The processor unit 124 then determines whether the respective portions indicate that reflected beam has been received at the receiver. In this embodiment, the processor unit 124 is configured to determine an intensity parameter based on each respective portion of the receiver output signal which relates to the intensity of infrared light received. The processor unit 124 is configured to compare the intensity parameter with a predetermined threshold intensity to determine whether a reflected beam has been received by the receiver. In this embodiment, the processor unit 124 includes a database 128 stored in memory 126 and which comprises predetermined threshold intensity values correlated by door gap and receiver ID. In particular, the threshold intensity value corresponding to determination of an obstacle may vary according to the size of the door gap, and may be set during commissioning tests of the automatic door installation. Accordingly, for each intensity parameter derived from a respective receiver output signal, the processor unit 124 looks up a corresponding threshold intensity parameter based on the door gap and the receiver ID. The processor unit 124 compares the intensity parameter with the threshold intensity parameter to determine whether a reflected signal has been received at the respective receiver.

If the intensity parameter is greater than the corresponding threshold intensity, the processor unit 124 determines that an obstacle is present, and transmits an obstacle signal to a door control unit 134 coupled to the doors 104, 106.

In this embodiment, the door control unit 134 is configured to temporarily prevent, halt or reverse a door closing operation when it receives an obstacle signal, thereby preventing the doors from closing on an obstacle. In other embodiments, the door control unit 134 (or the processor unit) may determine whether to prevent, halt or reverse a door closing operation based on a more complex obstacle checking procedure. For example, the door control unit 134 may be configured to only act on the determination of an obstacle (i.e. by preventing, halting or reversing a door closing operation) when two or more obstacle signals are received in a predetermined number of detection cycles, for example 3 detection cycles. Accordingly, the door control unit 134 may act to filter out anomalous obstacle detections.

In this embodiment, each receiver 118 is coupled to a 12 bit 3V analogue-to-digital converter configured to output a receiver output signal proportional to the intensity of infrared light received at the receiver and having a resolution of 4096 increments. A pre-scalar (not shown) is used to improve the resolution and dynamic range of the receiver output signal. For a door gap of 2 m, the database 128 stores a threshold intensity parameter for each of the receivers 118 of the receiver array 114 corresponding to 2000 increments on the ADC. This corresponds to the intensity of light expected to be received by each of the receivers 118 for a door gap of 2 m, and can be used for determining whether an obstacle is present, as will be described briefly below.

A procedure for determining whether an obstacle is present may employ a number of different signal processing methods. In this particular example, the processor unit 124 is configured to determine whether an obstacle is present by comparison of the receiver output signal and a threshold intensity parameter, and by analysing the rate of change of the receiver output signal.

In particular, the processor unit 124 processes the receiver output signal to determine an intensity parameter corresponding to an amount of light received. In this example, the processor unit 124 samples the receiver output signal over successive transmissions, for example three transmissions corresponding to 15 cycles of a carrier frequency each, and thereby obtains an average intensity parameter.

The processor unit 124 compares the average intensity parameter with a threshold intensity parameter, which in this example is derived by direct lookup from the database 128, which stores threshold intensity parameters correlated by receiver and door gap (current separation between the doors). In other examples, it may be necessary to interpolate a threshold intensity parameter for the particular door gap. In yet further examples, the threshold intensity parameter may be derived by extrapolating a previously measured value (for instance, from an earlier point in a door closing operation) and adjusting the previously measured value according to an expected change. For example, the processor unit 124 may adjust a previously measured value for a door gap of 1.8 m for a current door gap of 1.6 m by extrapolating the previously measured value based on a known, expected, or previously observed/recorded trend.

The comparison of the average intensity parameter with the threshold intensity parameter results in a difference value or delta value. The processor unit 124 compares the delta value with a noise threshold to determine whether it is significant. For example, a noise parameter may be derived based on a database comprising noise parameters correlating to expected or observed levels of noise at different door gaps. The noise parameters may also be correlated according to receiver, and may be adjusted based on other data available to the processor unit 124, such as a metric of the noise affecting the automatic door installation. Accordingly, the noise threshold may be an absolute value or may be determined based on monitored parameters.

In this example, the processor unit 124 determines if the delta value is greater than a noise threshold of two standard deviations of a noise parameter, which in this example is a metric of the noise affecting the automatic door installation. In other examples, the noise threshold may be a multiple of an average value of a noise parameter, for example three multiples of a mean noise parameter. Accordingly, if the delta value is greater than the noise threshold, the reason can be more reliably attributed to an increase in measured light intensity as opposed to a background level of noise affecting the automatic door installation.

The processor unit 124 also determines the rate of change of the intensity parameters as sampled from the receiver output signal over time. The processor unit 124 determines the sign of the rate of change, since a positive rate of change would be required to determine the presence of an obstacle for a proximity sensor. Further, the processor unit 124 compares the rate of change with predetermined values to determine whether the rate of change is indicative of the presence of an obstacle. The predetermined values may comprise an empirically-derived range corresponding to real-world obstacles, for example, by placing obstacles in the path of the proximity sensor. For example, a minimum predetermined value may correspond to the rate of change expected or observed when a small, semi-transparent object is introduced into the path of the proximity sensor. A maximum predetermined value may correspond to the rate of change expected or observed when a large, reflective object is introduced into the path of the proximity sensor. Accordingly, comparing the rate of change with such predetermined values may avoid false detections corresponding to non-physical results that may have other causes. The predetermined values may be derived or stored in a lookup table as a function of door gap and/or receiver ID.

In a second obstacle detection example shown in FIGS. 6 and 7, the door gap is reduced to only 1 m. In this configuration, the transmitter axis 120 and receiver axis 122 do not intersect. As shown in FIG. 6 (front view), the axes 120, 122 appear to overlap at a position right of the centre of the door gap. As shown in FIG. 7, the axes 120, 122 appear to overlap at a central position. In reality, the axes do not intersect at all, but only appear to overlap in these views (elevations). The closest distance between the two axis 120, 122 is the length of a line that is orthogonal to both the transmitter axis and the receiver axis.

Nevertheless, since the beam path 140 is dispersed around the transmitter axis 120 and the field of view 142 is dispersed around the receiver axis, the beam path 140 and field of view 142 still intersect to define a detection zone 144. However, neither one of the transmitter axis 120 and receiver axis 122 extend through the centre of the of the detection zone 144. In particular, the centre of the detection zone is defined as the midpoint on the line of closest separation between the transmitter axis 120 and receiver axis 122. As these axes do not intersect, then by definition neither one passes through the centre of the detection zone.

The detection zone 144 is therefore smaller in this second obstacle detection example than in the first obstacle detection example.

As in the first obstacle detection example, the processor unit 124 looks up a threshold intensity parameter for each transmission of the detection cycle based on the door gap (in this example 1 m) and the respective transmitter ID (or receiver ID). The processor unit 124 then determines an intensity parameter corresponding to the amount of infrared light received by the receiver based on a respective portion of the receiver output signal corresponding to the transmission, and compares the intensity parameter with the threshold intensity parameter as part of the determining whether an obstacle is present in the detection zone.

In this embodiment, the threshold intensity parameter for each of the receiver IDs (or transmitter IDs) at a door gap of 1 m is 2000 increments on the ADC. In this example embodiment, this is the same threshold intensity as in the first obstacle detection example, despite the door gap being different, and so the relative positions of the transmitters, receivers and detection zones. In other embodiments, the threshold intensity parameter may be different at different door gaps.

Several trends relating to the intensity of light received along a reflected pathway between a transmitter and receiver as the doors close will now be explained by reference to the first and second obstacle detection examples described above.

Firstly, the proportion of light within the beam path 140 that reaches the detection zone reduces from a maximum at the fully open door configuration (first obstacle detection example) as the doors close (i.e. towards the second obstacle detection example) owing to the reducing extent to which the beam path 140 of each transmitter 116 overlaps with the field of view 142 of the corresponding receiver 118. Accordingly, less infrared light transmitted from each transmitter 116 has the opportunity to be reflected to the corresponding receiver as the doors close, as some of the infrared light passes by the detection zone 144. In the first obstacle detection example, the beam path 140 and field of view 142 overlap to a greater extent than in the second obstacle detection example.

This first trend therefore results in a reduction in light intensity received at the receivers 118 as the doors close.

Secondly, reflected pathways increasingly diverge from the transmitter axis 120 and receiver axis 122 as the doors close towards each other. In particular, in the first obstacle detection example there is a reflected pathway for each transmitter-receiver pair having a first portion extending along the transmitter axis 120 to an obstacle 150 in the detection zone, and a second (reflected) portion extending form the obstacle 150 along the receiver axis 122 to the receiver 118. There are also many other reflected pathways which are dispersed around these axes. Nevertheless, the intensity of light received along the reflected pathway that is aligned with the axes 120, 122 would be the greatest as the intensity of light from the transmitter is greatest along the transmitter axis 120 (as described above), and the sensitivity of the receiver 118 is greatest along the receiver axis 122.

In contrast, as the doors move closer together, the transmitter and receiver axes 120, 122 move away from the centre of the detection zone 144 and on average the reflected pathways are tend to be more separated from the respective axes 120, 122. In particular, it is clear that as the transmitter axis 120 and the receiver axis 122 separate from one another, either a first portion (from the transmitter 116 to the obstacle 150) or a second portion (from the obstacle 150 to the receiver 118) of a reflected pathway must angularly diverge from the respective axes 120, 122.

This trend continues as the doors approach one another, such that the intensity of the transmitted beam and/or the sensitivity of the receiver to the reflected beam reduces as the door closes.

Accordingly, this second trend results in a reduction in light intensity received at the receivers 118 as the doors close.

These first and second trends, when considered independently of other trends, have the effect that the intensity of light received along a reflected pathway reduces as the doors close.

However, a third trend related to the length of a reflecting pathway also impacts the intensity of light received along a reflecting pathway between a transmitter 116 and corresponding receiver 118. In particular, the applicant has found that the intensity of light received along a reflecting pathway has a correlation with the square of the distance of the reflecting pathway, and higher-power correlations with distance are observed for longer pathways. Accordingly, this third trend results in an increasing intensity of infrared light received along a reflected pathway as the doors close.

The length of a reflecting pathway does not reduce to the extent observed in a conventional automatic door installation as shown in FIG. 1. In contrast, in a conventional automatic door installation the distance between each transmitter and its opposing receiver will reduce to zero as the doors close. Since there is an inverse square law of proportionality between light intensity received and separation distance, the light intensity rises exponentially as the doors approach the closed position, and the sensors must be configured to adapt to the exponential increase in light intensity. In contrast, in the example embodiment the vertical staggering of the transmitters and receivers results in a minimum distance of separation between each transmitter and the respective receiver, such that there is only a more moderate rise in light intensity as the doors approach the closed position, which may be balanced by the first and second trends described above (for reducing light intensity), as described below.

The transmitters and receivers are configured so that the first two trends identified above tend to counteract the third trend to some extent, such that the intensity of light received (or expected to be received) along a reflected pathway is kept within a desired range during a door closing operation. The trends are complex and non-linear and so it is generally not possible to optimise the geometric arrangement of the transmitters and receivers so that the intensity of light received along reflected pathways remains constant. Nevertheless, the applicant has found that geometric arrangement such as that proposed can result in significantly more uniform readings of received light intensity across the door gap than with previously considered automatic door installations.

Further, the applicant has found that staggering the transmitters 116 and receivers 118 as described above helps to limit cross-talk within transmitter-receiver pairs and thereby reduce the occurrence of false obstacle detections. Cross-talk is unwanted reception of an interfering signal. For example, in the context of an automatic door installation, cross-talk may include the reception of infrared light from one transmitter-receiver pair by the receiver of a second transmitter-receiver pair (inter-channel cross-talk). Further, cross-talk may include reception by a receiver of infrared light from a transmitter of the same transmitter-receiver pair along a non-reflected pathway, or an unintended or ad-hoc reflected pathway (i.e. not through the detection zone). For example, this type of cross-talk may include reception of infrared light along a direct (un-reflected) pathway between a transmitter and receiver, and multi-point reflection that does not pass through the detection zone, such as reflection off other obstacles in the door installation. It will be appreciated that such cross-talk can cause false obstacle detection.

The applicant has found that vertically staggering the transmitters and receivers helps to reduce cross-talk, particularly as the doors close. To consider again a conventional sensor arrangement as shown in FIGS. 1-2, each transmitter is directly opposite the corresponding receiver, and so the length of an un-reflected pathway between the transmitter and receiver reduces linearly and the intensity of light received along an un-reflected pathway thereby increases exponentially. Accordingly, in a conventional sensor arrangement, the strength of light along an un-reflected pathway between a transmitter and receiver of the same transmitter-receiver pair increases exponentially as the doors close, which may cause an obstacle to be falsely determined.

In contrast, with the vertically staggered arrangement there is a minimum distance of separation between the transmitter and receiver (in the above example, 300 mm), and so the intensity of received light along an un-reflected pathway only increases moderately as the doors close, and so cross-talk from a transmitter to the respective receiver that may cause false obstacle detection is less likely to occur.

Further, in the particular embodiment shown, the minimum distance of separation is greater than half of the spacing between adjacent transmitters/receivers. In particular, the minimum distance of separation for a transmitter and the respective receiver is 300 mm (their vertical separation), whereas the spacing between adjacent transmitters (and between adjacent receivers) is 400 mm. Accordingly, each transmitter is closer to a receiver of a different transmitter-receiver pair than its respective receiver. Accordingly, the minimum distance of separation is greater than would be possible if the transmitters and receivers were arranged in an unpaired configuration (i.e. whereby an obstacle can be detected when a beam from a transmitter can be received by any of the receivers) with level (horizontal) transmitter and receiver axes 120, 122. In other embodiments, each transmitter could be level with a receiver of a different transmitter-receiver pair, or may be disposed above such a receiver (i.e. vertically spaced apart from its respective receiver by more than the vertical spacing between adjacent receivers).

Further, as described above, the transmitters 116 and receivers 118 are provided with housings, such as frusto-conical housings, which limit the angular extent of the beam path 140 and the field of view 144. Accordingly, in this embodiment un-reflected pathways between each transmitter (e.g. transmitter ID 1) and any unpaired receivers (e.g. receiver ID 2) are blocked, in particular any un-reflected pathway between each transmitter and the closest unpaired receiver 116. For example, even though transmitter ID 1 is vertically closest to receiver ID 2 with a vertical spacing of 100 mm, the transmitter housing blocks any un-reflected pathway therebetween. Similarly, although receiver ID 1 may lie within the beam path 140 for transmitter ID 2, the receiver housing is configured to block any un-reflected pathway therebetween.

The transmitter housings and receiver housings therefore help to reduce inter-channel cross-talk, particularly when the minimum separation distance between the transmitter and receiver of each pair is greater than half the spacing between adjacent receivers (or transmitters).

Although embodiments have been described in which the transmitters and receivers are configured in transmitter-receiver pairs so that an obstacle is only determined to be present when a receiver receives a beam from the respective transmitter, it will be appreciated that in other embodiments the transmitters and receivers may be unpaired. For example, there may be no pairing within the circuitry of the sensor. Further, there may be no time-division multiplexing of the transmissions.

The invention claimed is:

1. An automatic door installation configured to determine the presence of an obstacle in one or more detection zones remote from a door opening, comprising:

at least a first door slidable in a door opening along a horizontal door axis from an open configuration to a closed configuration during a door closing operation;

a plurality of transmitter-receiver pairs, each transmitter-receiver pair comprising:

a transmitter for transmitting a beam and a receiver for receiving the beam along a reflected pathway, wherein one of the transmitter and the receiver is coupled to the first door so that, in use, the transmitter and receiver move closer together during the door closing operation;

wherein the transmitter defines a transmitter axis corresponding to the optical axis of the beam;

wherein the receiver has a field of view for receiving the reflection of the beam, which is oriented around a receiver axis;

wherein the transmitter axis and the receiver axis are configured so that the beam and the field of view overlap to define a detection zone for the transmitter-receiver pair in at least one operational configuration of the door installation;

wherein at least one of the transmitter axis and the receiver axis is inclined with respect to the horizontal plane; and wherein the transmitter is vertically spaced apart from the receiver.

2. An automatic door installation according to claim 1, wherein the transmitters and receivers are staggered so that each transmitter is vertically spaced apart from each receiver.

3. An automatic door installation according to claim 1, wherein each detection zone includes a centre, and wherein the centres of the detection zones are vertically spaced apart.

4. An automatic door installation according to claim 3, wherein the transmitter-receiver pairs are configured so that the centres of the detection zones are vertically spaced apart when the automatic door installation is in the open configuration.

5. An automatic door installation according to a claim 1, wherein for each transmitter-receiver pair, at least one of the transmitter axis and the receiver axis is substantially horizontal.

6. An automatic door installation according to claim 1, wherein the transmitter axes of the plurality of transmitter-receiver pairs are substantially parallel with each other.

7. An automatic door installation according to claim 1, wherein the receiver axes of the plurality of transmitter-receiver pairs are substantially parallel with each other.

8. An automatic door installation according to claim 1, wherein each transmitter-receiver pair is configured so that there is a reflecting pathway between the transmitter and receiver when a reflecting obstacle is disposed in the respective detection zone.

9. An automatic door installation according to claim 8, wherein each transmitter-receiver pair is configured so that the intensity of the beam along the reflecting pathway from the transmitter to the detection zone is greater than the signal intensity of the beam along a non-reflecting pathway extending directly between the transmitter and receiver.

10. An automatic door installation according to claim 1, wherein each transmitter-receiver pair is configured so that a shortest distance of separation between the transmitter axis and the receiver axis varies during the door closing operation.

11. An automatic door installation according to claim 10, wherein the shortest distance of separation between the transmitter and receiver axis increases during the door closing operation.

12. An automatic door installation according to claim 1, wherein the angle between respective projections of the transmitter axis and the receiver axis onto the plane of the door opening is between 150° and 170°.

13. An automatic door installation according to claim 1 wherein for each transmitter-receiver pair, one of the transmitter axis and the receiver axis is inclined with respect to the horizontal plane by an angle of between 5° and 60°.

14. An automatic door installation according to claim 1, further comprising a second door slidable in the door opening opposite the first door, wherein the transmitter and the receiver of each transmitter-receiver pair are respectively mounted on opposing doors.

15. An automatic door installation according to claim 1, wherein each transmitter-receiver pair, or a controller of the automatic door installation, is configured so that the presence of an obstacle is only determined when a receiver receives an optical signal from a respective transmitter of the same pair.

16. An automatic door installation according to claim 1, wherein the vertical separation between a transmitter of a first transmitter-receiver pair and a receiver of a second transmitter-receiver pair is less than the vertical separation between the transmitter and the respective receiver of the first pair.

17. An automatic door installation configured to determine the presence of an obstacle in one or more detection zones remote from a door opening, said automatic door installation comprising:

at least a first door slidable in a door opening along a horizontal axis between an open position to a closed position;

at least one transmitter for transmitting electromagnetic energy along a transmitter axis such that an intensity of the electromagnetic energy is greatest along the transmitter axis and reduces at angles away from the transmitter axis;

at least one receiver for receiving electromagnetic energy along a receiver axis such that a sensitivity of the receiver to electromagnetic energy is greatest along the receiver axis and reduces at angles away from the receiver axis;

wherein the transmitter axis and the receiver axis are angularly disposed to each other;

wherein the transmitter and the receiver are not positioned at the same height;

wherein at least one of the transmitter and receiver is coupled to the first door such that the transmitter and the receiver move away from each other when the first door is being opened; and wherein during closing of the first door the transmitter axis and the receiver axis overlap to define a detection zone that includes area not directly between the transmitter and the receiver.

18. An automatic door installation according to claim 17, wherein the automatic door installation includes a plurality of pairs of transmitters and receivers.

19. An automatic door installation according to claim 17, wherein at least one of the transmitter and receiver is coupled to the first door and the other of the transmitter and receiver is coupled to a door frame.

20. An automatic door installation according to claim 17, wherein at least one of the transmitter and receiver is coupled to the first door and the other of the transmitter and receiver is coupled to a second door.

* * * * *